US008279128B2

(12) United States Patent
McQuaid et al.

(10) Patent No.: US 8,279,128 B2
(45) Date of Patent: Oct. 2, 2012

(54) TAPERED SLOT ANTENNA

(75) Inventors: Matthew M. McQuaid, Hudson, NH (US); Michael J. O'Brien, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 328 days.

(21) Appl. No.: 12/775,894

(22) Filed: May 7, 2010

(65) Prior Publication Data

US 2011/0273349 A1 Nov. 10, 2011

(51) Int. Cl.
*H01Q 13/10* (2006.01)

(52) U.S. Cl. ..... 343/767; 343/700 MS

(58) Field of Classification Search ..... 343/767, 343/768, 769, 700 MS
See application file for complete search history.

(56) References Cited

U.S. PATENT DOCUMENTS

| | | | | |
|---|---|---|---|---|
| 4,853,704 | A | 8/1989 | Diaz et al. | |
| 6,075,493 | A | 6/2000 | Sugawara et al. | |
| 6,642,898 | B2 | 11/2003 | Eason | |
| 6,850,203 | B1 * | 2/2005 | Schuneman et al. | 343/767 |
| 2005/0012672 | A1 * | 1/2005 | Fisher | 343/767 |

* cited by examiner

*Primary Examiner* — Hoanganh Le
(74) *Attorney, Agent, or Firm* — Sand & Sebolt; Rodney E. Haven

(57) ABSTRACT

Methods, antennas and other embodiments associated with impedance matching an antenna feed slot are based on a fractal shape. A slot antenna includes a planar metal sheet. A feed slot opening is formed in the metal sheet. The feed slot has a first end and a second end. A tapered opening is formed in the metal sheet. Adjacent sides of the tapered opening touch the first end of the feed slot. An impedance matching fractal shaped opening is formed in the metal. The impedance matching fractal shaped opening touches the second end of the feed slot.

20 Claims, 8 Drawing Sheets

TAPERED SLOT ANTENNA

STATEMENT OF GOVERNMENT INTEREST

The invention was made with United States Government support under Contract No. FA86290-06-G-4028-0008 awarded by the United States Air Force. The United States Government has certain rights in this invention.

BACKGROUND OF THE INVENTION

1. Technical Field

The present invention relates generally to apparatus and systems for transmitting and sending electromagnetic radiation. More particularly, the apparatus and systems relate to transmitting and sending electromagnetic radiation with antennas. Specifically, the apparatus and systems of the present invention involve a tapered slot antenna for transmitting and sending electromagnetic signals.

2. Background Information

Tapered slot antennas (TSAs) belong to the general class of end-fire travelling wave antennas and include a tapered slot etched onto a thin film of metal. A TSA can be very economically etched onto a printed circuit board (PCB) film with or without a dielectric substrate on one side of the film. TSAs can be formed on PCBs of mobile devices such as cellular telephones. Besides being efficient and lightweight, TSAs are often used because they can work over a large frequency bandwidth and produce a symmetrical end-fire beam with appreciable gain and low side lobes. TSAs also generally have wider bandwidth, higher directivity and are able to produce more symmetrical radiation patterns than other antennas such as horn antennas.

TSAs are a class of endfire antennas known as surface wave antennas. Several types of TSAs exist, the most common being linear-tapered slot antennas (LTSAs), Vivaldi-tapered slot antennas (VTSAs) and constant-width tapered slot antennas (CWTAs). The beam widths of CWSAs are typically the smallest, followed by LTSAs and VTSAs. The side lobe levels are typically the largest for VTSAs, followed by LTSAs and CWSAs.

A TSA is formed by slowly increasing the width of a slot from the point of its feed to an open end of width generally greater than $\lambda_O/2$, where $\lambda_O$ is the center frequency. The impedance, bandwidth and radiation patterns of the TSA are greatly affected by parameters such as length, width and taper profile of the TSA. The dielectric substrate's thickness and relative permittivity can also contribute to the efficiency of the antenna. While current TSA's provide good performance characteristics at relatively inexpensive costs, improvements can be made.

BRIEF SUMMARY OF THE INVENTION

The preferred embodiment of a slot antenna includes a dielectric sheet and a metal sheet on the dielectric sheet. The metal sheet includes a slot opening, a tapered opening and an impedance matching opening in the metal sheet. The slot opening is formed in the metal sheet with a first end and a second end. The tapered opening is formed in the metal sheet beginning at the first end of the slot and ending at a side of the metal sheet. The tapered opening generally increases from the first end of the slot toward the side of the metal sheet. The impedance matching opening in the metal sheet is formed in the shape of a fractal adjacent the second end of the slot opening. The impedance matching opening is formed to act as an open circuit.

In one configuration of the preferred embodiment, the impedance matching opening is formed in the shape of a Koch fractal. The Koch fractal is based, at least in part, on a triangle. The Koch fractal is at least a second order Koch fractal. The impedance matching opening in the fractal shape is shaped with at least two major arms. One of at least two major arms is adjacent and touches the second end of the slot opening. At least two major arms are spaced apart equal circumferential distances from each other in a generally circular pattern. At least two major arms have arm tips that touch a circle around the impedance matching opening.

In one configuration of the preferred embodiment, the slot antenna has an impedance matching opening shaped with six major arms spaced apart equal circumferential distances from each other in a generally circular pattern. At least one minor arm extends outwardly from each major arm. The major arms include arm bases. Arm bases that are adjacent each other contact each other forming an open area defined by an inner circle.

Another configuration of the preferred embodiment includes a method. The method creates a slot antenna by creating a slot, a tapered opening and a fractal shaped opening. The method creates a slot in a metal sheet with a first end and a second end. A tapered opening is created in the metal sheet beginning at the first end of the slot. The tapered opening increases from the first end to an outer edge of the metal sheet. A fractal shaped opening is created in the metal sheet adjacent the second end of the slot.

The method can include creating the fractal shaped opening so that the fractal shaped opening is configured to approximate an open circuit. The slot, tapered opening and fractal shaped opening can be created in a metal sheet that is deposited on a dialect material of a printed circuit board (PCB).

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION OF THE INVENTION

Figure 1:
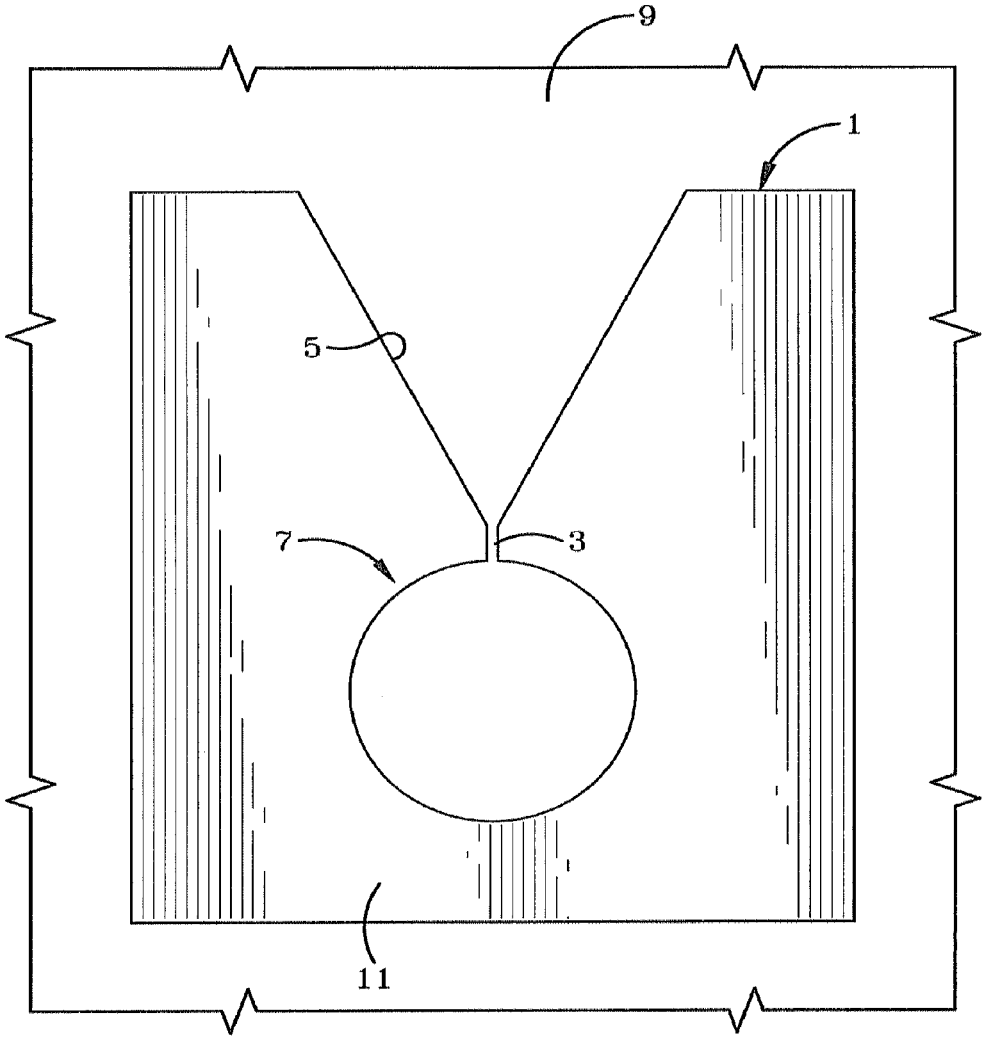
FIG-1 PRIOR ART
FIG. 1 illustrates a top view of a prior art tapered slot antenna with a circular impedance matching shape.

FIG. 1 illustrates a prior art tapered slot antenna (TSA) 1 fabricated on a printed circuit board (PCB) 9. A tapered slot antenna 1 is formed by creating a slot 3, a tapered opening 5, and an impedance matching shape 7 in a metal layer 11 that is deposited on a dielectric material. The impedance matching shape 7 is also called a stub termination that terminates the slot 3. In the traditional TSA 1, the slot 3 is adjacent (e.g., connected to) an impedance matching shape 7 (e.g., stub) in the shape of a circle that acts as an ideal open circuit.

Figure 2:
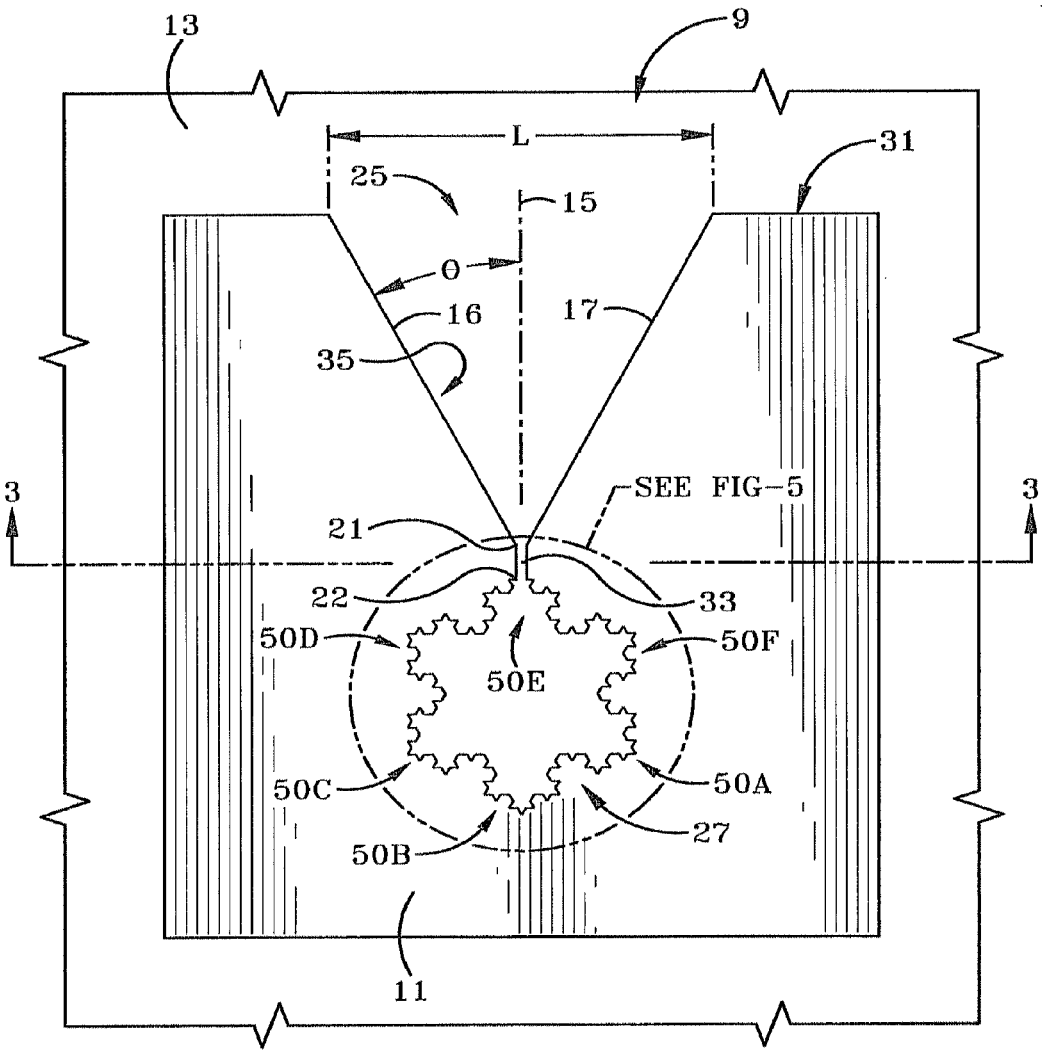
FIG. 2 illustrates a top view of the preferred embodiment of a tapered slot antenna with impedance matching shape in the form of a fractal.

FIG. 2 illustrates the preferred embodiment of a TSA 31. This TSA 31 can be fabricated on a PCB 9 similar to the prior art TSA of FIG. 1. The TSA 31 of the preferred embodiment also is formed with a slot 33, a tapered opening 35, and an impedance matching shape 27 in a metal layer 11. The impedance matching shape 27 is also called a stub termination that terminates the slot 33. The impedance matching shape 27 of the preferred embodiment is formed in the shape of a fractal rather than a circle. The particular fractal shown in the preferred embodiment is a Koch fractal based on a triangle, however, other fractal shapes can be used as discussed below.

Both the prior art impedance match shapes 7 of a circle and the preferred embodiment impedance matching shape 27 of a triangular Koch fractal have a sufficient perimeter to match to an open circuit. The perimeter length of the preferred impedance matching shape 27 of FIG. 2 is similar to the perimeter length of the prior art impedance matching shape 7 shown in FIG. 1. Even though the perimeters are similar, the outside diameter of the fractal shape 27 of the preferred embodiment of FIG. 2 is significantly less than the outside diameter of the prior art circle shape of FIG. 1. The smaller diameter means that less PCB 9 area is needed to implement the preferred embodiment of the TSA 31 shown in FIG. 2 than the prior art TSA 1 shown in FIG. 1. This means either the PCB 9 of the preferred TSA 31 can be smaller or more circuits may be implemented on the PCB 9 with the preferred TSA 31 than with the prior art TSA 1 of FIG. 1. Using a fractal shaped stub can improve the TSA 31 performance at lower frequencies. Additionally, a triangular Koch fractal shaped stub provides a shunt resistance along the perimeter of the fractal shape to enable the stub to approximate an ideal open circuit over an extended bandwidth.

Figure 4A:
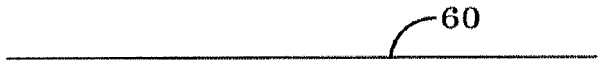
FIGS. 4A-E illustrate the first five fractal orders of a triangular Koch fractal.
Figure 4B:
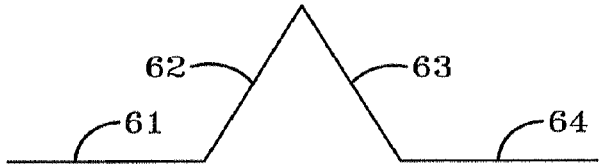
Figure 4C:
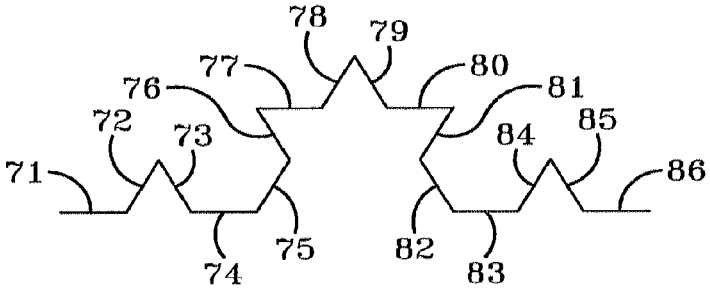
Figure 4D:
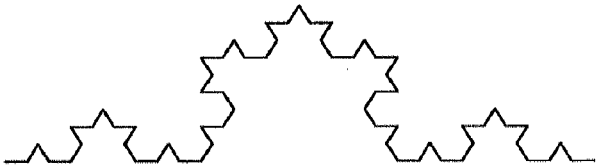
Figure 4E:
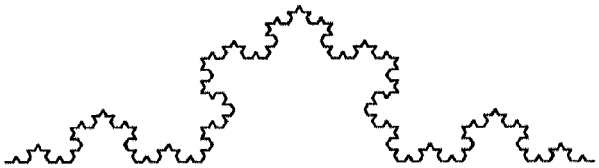

The Koch fractal of the preferred embodiment is a Koch fractal based on a triangle and is generally greater than a fourth order Koch fractal. FIGS. 4A-E illustrate the first through fifth orders of a Koch fractal based on a triangle. The first order shown in FIG. 4A is a line segment 60. The second order shown in FIG. 4B is generated by removing the middle third of the line segment and replacing it with two line segments in the form of a triangle to create four lines segments 61, 62, 63, 64. The third order shown in FIG. 5C is generated by performing the same operation on the four line segments 61, 62, 63, 64 of the second order fractal to create the 16 line segments (71 to 86) of the third order fractal. This iterative approach of creating a Koch fractal can be continued to create the fourth and fifth ordered fractals as shown in FIGS. 4D and 4E, respectively, and can be further continued to create higher order fractals than what is shown in FIG. 4.

A fractal can be created that is based on other shapes than a triangle. The middle third of a line segment can be replaced with other shapes rather than triangle shaped line segments. For example, a square shape, a trapezoidal shape, or another type of shape can be used to replace the middle third of a line segment of a prior order fractal.

For simplicity, FIGS. 4A-E illustrate creating a fractal starting from a line. However, to create the relatively circular shaped impedance matching fractal shape 27 shown in FIGS. 2 and 5, one would begin with an equilateral triangle and iteratively replace the middle third of the line segments with triangular shaped line segments as previously discussed. Rather than starting with an equilateral triangle, the preferred embodiment can also be based on starting with an equilateral pentagon and iteratively replace the middle third of the line segments with triangular shaped line segments.

The tapered slot antenna 31 transmits a signal fed into the slot 33 or receives a signal at the slot 33. As previously mentioned, the tapered opening 35 is formed by gradually increasing the width of the tapered opening 5 from a first end 21 of the slot 33 to an open end 25 of the tapered opening 35. It is generally desirable to have the length L of the open end 25 be greater than $\lambda_O/2$, where $\lambda_O$ is the center frequency of a signal the TSA 31 is to transmit. The impedance, bandwidth and radiation patterns of the TSA 31 are significantly affected by parameters such as length, width and taper profile of the TSA 31.

The tapered opening 35 may be other shapes than the tapered opening with straight sides 16, 17 shown in FIG. 2. The tapered opening 35 can have constant, linear and/or exponential tapers. For example, the tapered opening 35 can have sides 16, 17 that are curved as expressed by exponential or tangential functions. The TSA 31 can be a Vivaldi type of TSA with a corresponding Vivaldi shaped tapered opening 35. Alternatively, the tapered opening 35 can have sides 16, 17 that are made up of more than one straight line segment or a combination of straight line segments and curved line segments, and so on.

Figure 3:
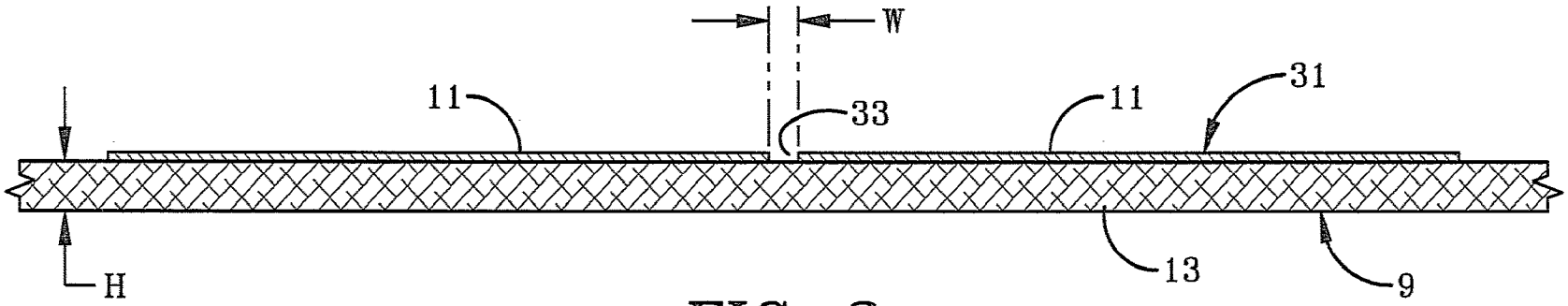
FIG. 3 illustrates a cross-sectional view taken on line 3-3 of FIG. 2 of the tapered slot antenna.

FIG. 3 shows a cross-sectional view of the slot 33 of the TSA 31. As shown in this figure, the metal layer 11 is deposited on top of dielectric material 13 that has a thickness H. The thickness of the dielectric material 13 and the relative permittivity of the dielectric material 13 can also contribute to the efficiency of the TSA 31.

The TSA 31 shown in FIG. 2 is capable of operating somewhere in a frequency bandwidth between of 50 MHz to 18 GHz. To achieve a wide bandwidth, an impedance matching shape 27 of a fractal is placed adjacent to the slot 33. This allows the tapered opening 35 to act as a transformer taking the 377 ohm free-space impedance down to about 50 ohms.

In operation, the TSA 31 can be fed (e.g., excited) to transmit signals in different ways as understood by those of ordinary skill in the art, For example, the slot 33 can be excited using the center conductor of a coaxial cable 67 to feed the slot 33 a signal. Alternatively, a micro-strip line can feed the slot 33 by extending over the slot 33 by about a quarter of a wavelength. Alternatively, the slot 33 can be fed from a other feeds such as a coplanar waveguide (CPW), an air-bridge ground coplanar waveguide (GCPW), a finite coplanar waveguide (FCPW)/center-strip, a FCPW/notch as well as other types of feeds.

When the TSA 31 is fabricated on a PCB 9, the dielectric material 13 of the preferred embodiment is preferably a high dielectric constant. Thick dielectric substrates with low dielectric constants can also be used and may provide adequate efficiency and a wide bandwidth. However, using thick substrates with low dielectric constants will increase the area of the PCB 9 needed to fabricate the TSA 31 as compared to using a high dielectric material. In other embodiments, a variety of other dielectric constants with dielectric material 13 of different thicknesses can be used based on different design parameters.

Figure 5:
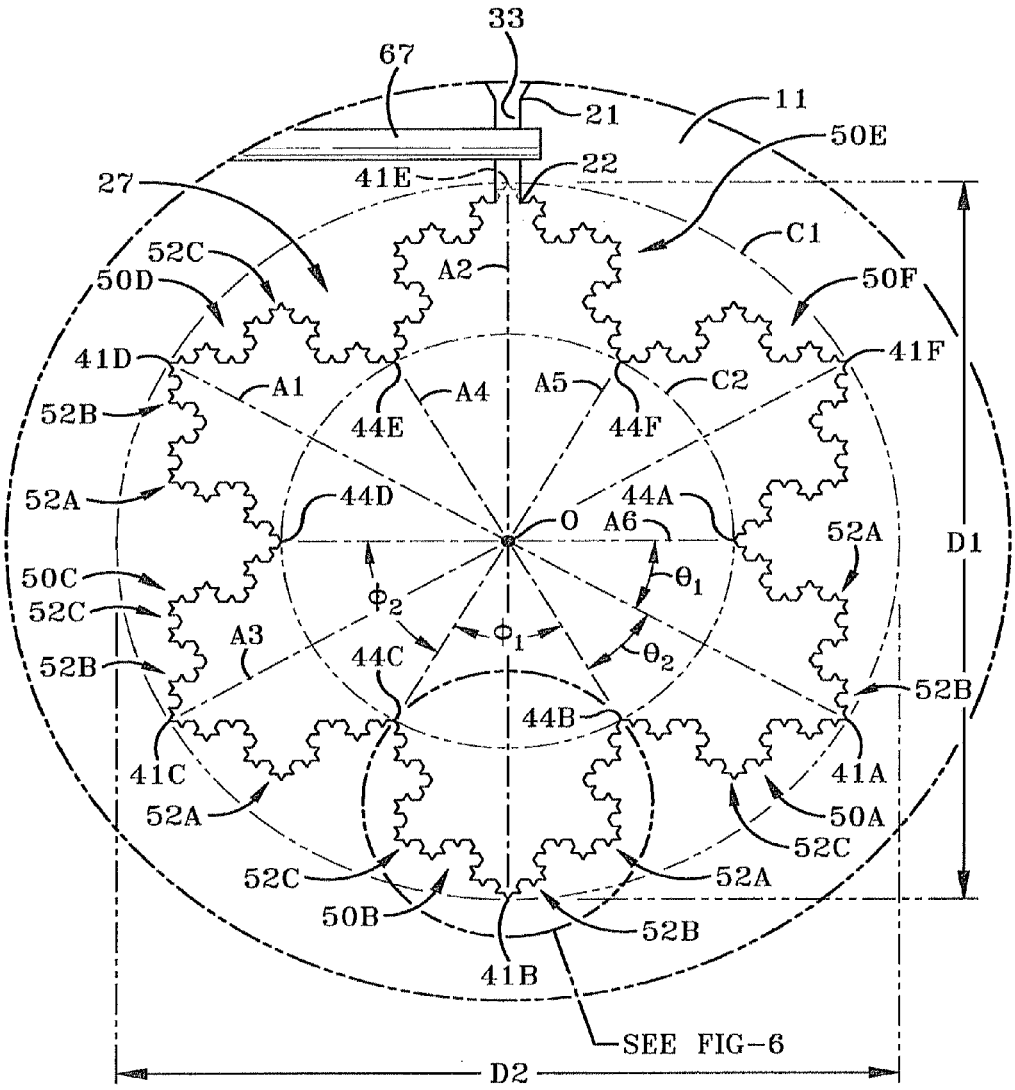
FIG. 5 illustrates an enlarged view of the encircled portion of FIG. 2.

The impedance matching shape 27 can overall be fractal shaped with six major lobes 50A-F. In another configuration, the preferred embodiment can have 10 major lobes; however, for drawing simplicity FIG. 5 is drawn with six major lobes 50A-F. The inner perimeter of the impedance matching shape 27 defines the major lobes 50A-F. The major lobes 50A-F extend radially outward from the center O and are arranged in an oval or circular pattern as shown in FIG. 5. For example, the diameters D1 and D2 shown in FIG. 5 are of similar lengths which results in the shape 27 that is circular as shown by circles C1 and C2. However, if diameters D1 and D2 have different lengths then the impedance matching shape 27 would be more elliptical. In the preferred embodiment, the major lobes 50A-F are spaced equal circumferential distances from each other in the circular pattern. The outer circle C1 touches the tips 41A-F (ends) of the six major lobes 50A-F. The inner circle C2 touches bases 44A-F of the major lobes 50A-F and represents that the area within circle C2 is a circular completely open area void of metal.

FIG. 5 also illustrates other features of the preferred embodiment of the impedance matching shape 27. For example, circles C1 and C2 are concentric with a common center O in the preferred embodiment. The impedance matching shape is also symmetrical (with the minor exception of slot 33 for axes other than A2) about axes A1, A2, A3, A4, A5 and A6, all of which pass through center O. Axis A1 passes through tips 41A and 41D. Axis A2 passes through tips 41B and 41E. Axis A3 passes through tips 41C and 41F. Axis A4 passes through bases 44B and 44E. Axis A5 passes through bases 44C and 44F. Axis A6 passes through bases 44A and 44D. In the preferred embodiment, the angles $\theta_1$ between a tip 41A and base 44A is the same as the angle $\theta_2$ between the tip 41A and an adjacent base 44B. Also, the angle $\phi_1$ between the bases 44B and 44C of one major node 50B is the same as the angle $\phi_2$ between the bases 44C and 44D of an adjacent major node 50C.

Figure 6:
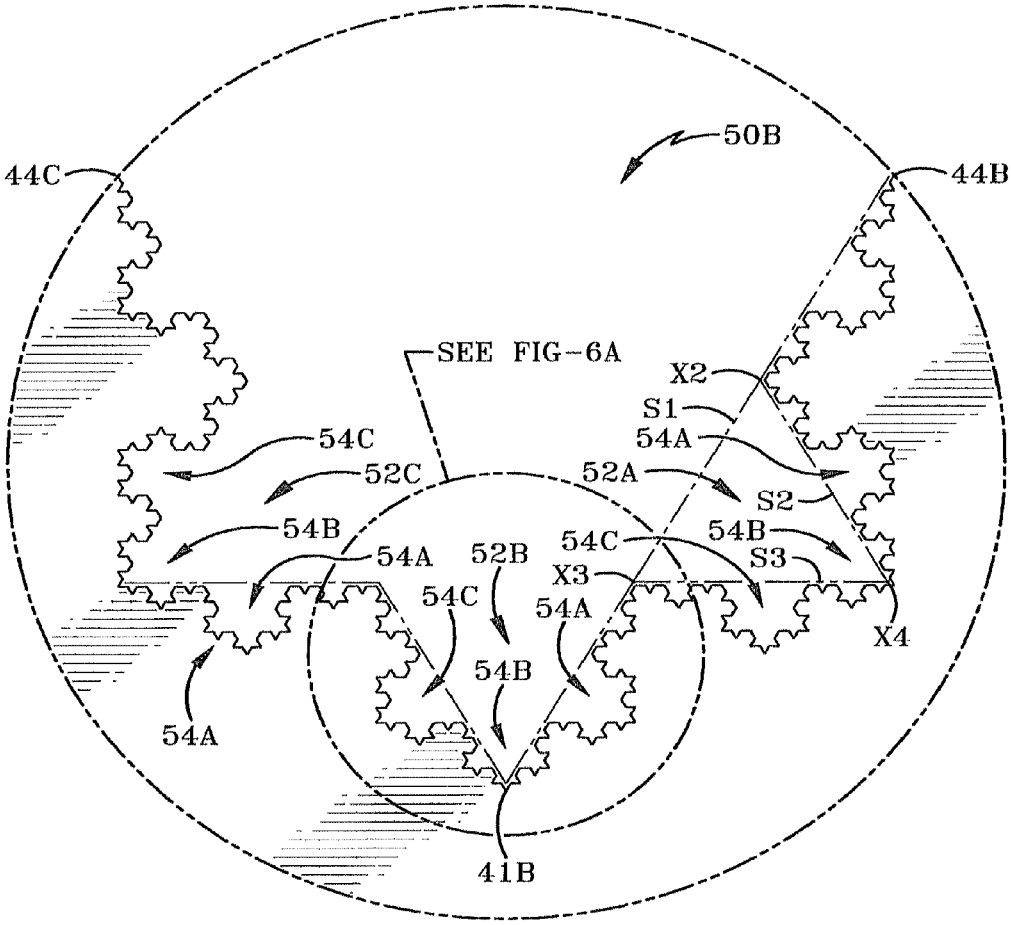
FIG. 6 illustrates an enlarged view of the encircled portion of FIG. 5.
Figure 6A:
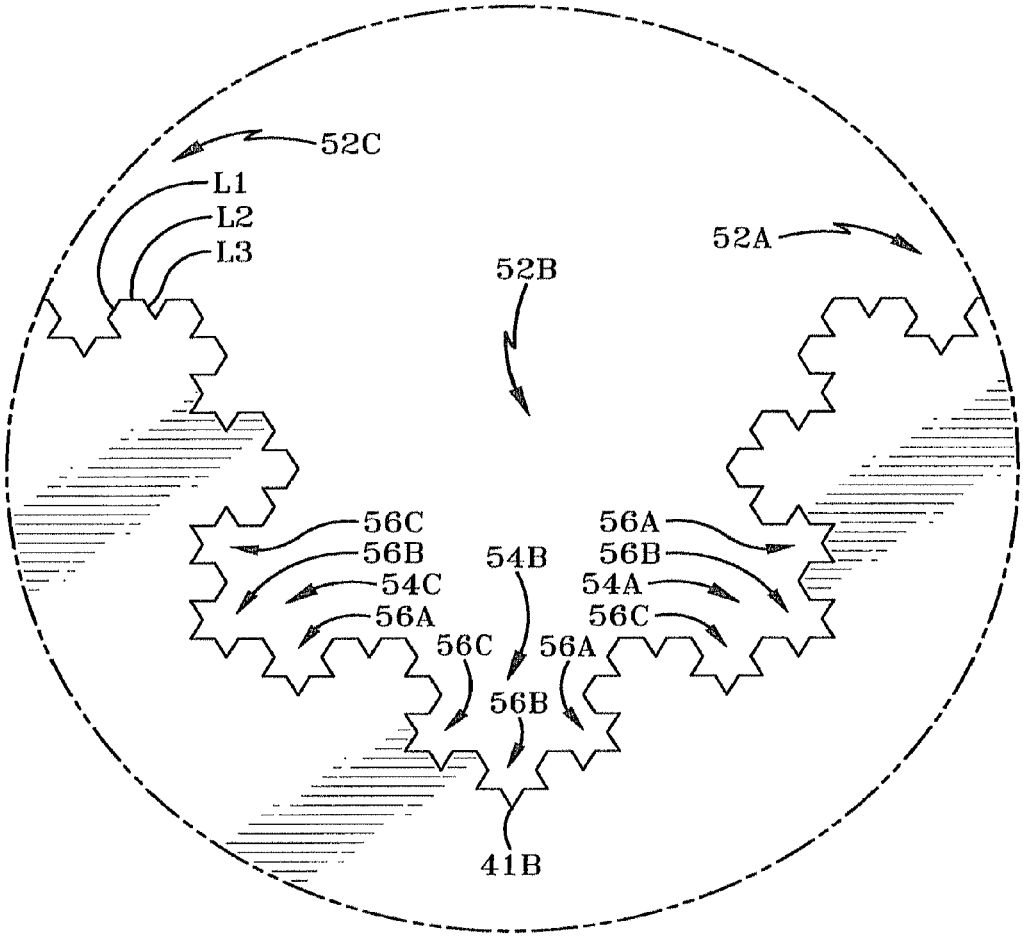
FIG. 6A illustrates an enlarged view of the encircled portion of FIG. 6.

FIG. 6 illustrates a detailed view of major node 50B of FIG. 5. Major node 50B has a minor lobes 52A-C with sub-minor lobes 54A-C. Because of the definition of a fractal, each sub-minor lobe 54A-C may contain even further sub-minor lobes 56A-C as best viewed in FIG. 6A. And the sub-minor lobes 56A-C can contain further sub-minor lobes, and so on. Line segments L1-3 each are of the same length and are connected back to back at their tips. A plurality of line segments similar to lines segments L1-3 for the perimeter of major lobe 50B and the overall fractal shape shown in FIG. 5. Line segment S1 spans between base 44B and tip 41B to form part of the opening for major lobe 50B. Line segments S2 and 83 extend radially outward from line segment S1 at points X2 and X3 respectively and meet at point X4.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 7:
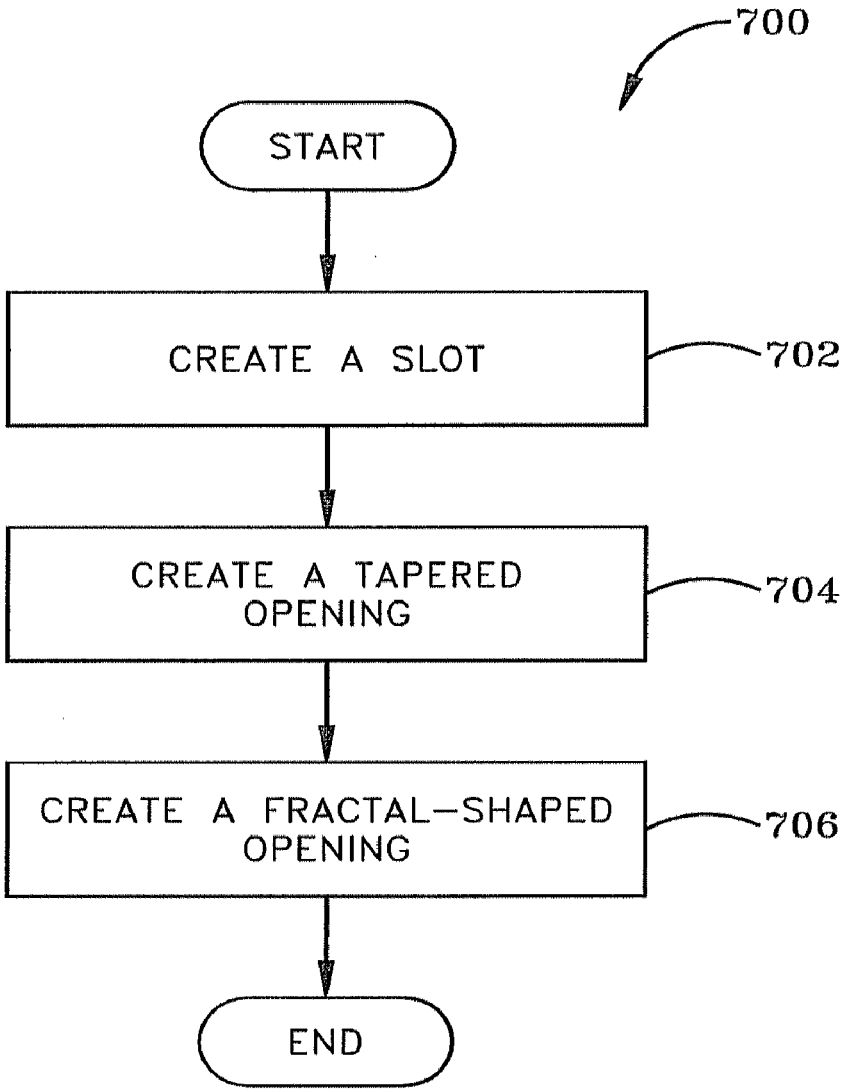
FIG. 7 illustrates a method of forming the tapered slot antenna of the preferred embodiment.

FIG. 7 illustrates a method 700 of fabricating a slot antenna. The method 700 creates a slot, at 702. The slot has a first end and a second end. The slot may be formed into a sheet of copper or other metal over a dielectric material on a printed circuit board (PCB). A tapered opening is created, at 704. The tapered opening is crated in the same metal sheet as the slot beginning at the first end of the slot. The tapered opening increases from the first end to an outer edge of the metal sheet. The tapered opening can be a linear tapered opening with straight sides. Alternatively, the sides can be curved or other shapes.

A fractal shaped opening is created, at 706, in same metal sheet as the slot and the tapered opening. The fractal shaped opening may be in the shape of a Koch fractal and be based on a triangle. The fractal shaped opening is configured to approximate an open circuit to impedance match the slot. The fractal shaped opening is formed adjacent the second end of the slot. The fractal shape can have about six arms major lobes with several minor lobes.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A slot antenna comprising:

a dielectric sheet;

a metal sheet on the dielectric:

a slot opening formed in the metal sheet with a first end and a second end;

a tapered opening formed in the metal sheet, wherein the tapered opening begins at the first end of the slot and ends at a side of the metal sheet, wherein the tapered opening generally increases from the first end of the slot toward the side of the metal sheet; and an impedance matching opening in the metal sheet formed in the shape of a fractal adjacent the second end of the slot opening.

2. The slot antenna of claim 1 wherein the impedance matching opening is formed in the shape of a Koch fractal.

3. The slot antenna of claim 2 wherein the Koch fractal is based, at least in part, on a triangle.

4. The slot antenna of claim 2 wherein Koch fractal is at least a third order Koch fractal.

5. The slot antenna of claim 1 wherein the impedance matching opening is formed in the shape of at least a second order fractal.

6. The slot antenna of claim 1 wherein the impedance matching opening is shaped with at least two major arms.

7. The slot antenna of claim 6 wherein one of the at least two major arms is adjacent and touches the second end of the slot opening.

8. The slot antenna of claim 6 wherein the at least two major arms are spaced apart equal circumferential distances from each other in a generally circular pattern.

9. The slot antenna of claim 6 wherein the at least two major arms have arm tips that touch a circle around the impedance matching opening.

10. The slot antenna of claim 6 wherein the at least two major arms extend radially outward from a common center point.

11. The slot antenna of claim 6 wherein the at least two major arms further comprise:

arm bases, wherein arm bases that are adjacent contact each other and, wherein the arm bases touch an inner circle that forms an open area void formed in the metal sheet.

12. The slot antenna of claim 1 wherein the impedance matching opening is shaped with six major arms spaced apart equal circumferential distances from each other in a generally circular pattern.

13. The slot antenna of claim 12 further comprising:

at least one minor arm extending outwardly from each major arm.

14. The slot antenna of claim 1 wherein the impedance matching opening is configured to act as an open circuit.

15. A slot antenna comprising:

a planar electrical conductor formed with openings comprising:

a feed slot having a first end and a second end;

a tapered opening communicating with the first end of the slot; and an impedance matching opening which communicates with the second end of the slot and comprises:

a central opening;

a plurality of first arm openings extending radically outward from the central opening;

a plurality of second arm openings smaller than and extending outwardly from the first arm openings.

16. The slot antenna of claim 15 further comprising:

a plurality of third arm openings which are smaller than and extend outwardly from the second arm openings.

17. The slot antenna of claim 16 further comprising:

a plurality of fourth arm openings which are smaller than and extend outwardly from the third arm openings.

18. The slot antenna of claim 15 further comprising:

a plurality of third arm openings which are smaller than and extend outwardly from the first arm openings.

19. A method comprising:

creating a slot antenna by:

creating a slot in a metal sheet with a first end and a second end;

creating a tapered opening in the metal sheet beginning at the first end of the slot, wherein the tapered opening increases from the first end to an outer edge of the metal sheet; and creating a fractal shaped opening in the metal sheet adjacent the second end of the slot to impedance match the slot antenna.

20. The method of claim 19 wherein the fractal shaped opening is shaped based, at least in part, on a Koch fractal.

* * * * *